US007634219B2

(12) United States Patent
Ito

(10) Patent No.: US 7,634,219 B2
(45) Date of Patent: Dec. 15, 2009

(54) TRANSFER MEDIA TRANSPORT GUIDE MECHANISM FOR IMAGE FORMING DEVICE

(75) Inventor: Hiroshi Ito, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 11/867,441

(22) Filed: Oct. 4, 2007

(65) Prior Publication Data

US 2008/0031659 A1 Feb. 7, 2008

Related U.S. Application Data

(63) Continuation of application No. 10/908,576, filed on May 17, 2005, now Pat. No. 7,333,761.

(30) Foreign Application Priority Data

May 18, 2004 (JP) ..... 2004-148102

(51) Int. Cl.
*G03G 15/16* (2006.01)

(52) U.S. Cl. ..... 399/316

(58) Field of Classification Search ..... 399/316, 399/124, 322, 323

See application file for complete search history.

(56) References Cited

U.S. PATENT DOCUMENTS

| | | | | |
|---|---|---|---|---|
| 4,110,027 | A * | 8/1978 | Sato et al. | 399/317 |
| 6,256,472 | B1 * | 7/2001 | Miyake et al. | 399/316 |
| 6,970,676 | B2 * | 11/2005 | Ito et al. | 399/316 |
| 2004/0170453 | A1 * | 9/2004 | Ito et al. | 399/316 |

FOREIGN PATENT DOCUMENTS

JP 09-240880 A 9/1997

* cited by examiner

*Primary Examiner*—David M Gray
*Assistant Examiner*—Ruth N Labombard
(74) *Attorney, Agent, or Firm*—Global IP Counselors, LLP

(57) ABSTRACT

An image forming device is disclosed that can control image blurring, image contraction, and the like when resilient transfer media such as cardboard is to be transported upward from a pair of resist rollers and guided to a transfer position, and obtain a suitable transfer image. Transfer media is transported upward by resist rollers, and guided toward a transfer position by a pair of guide plates. Because tip of a resilient transfer medium such as cardboard may spring back to its original shape after it separates from the resist rollers, one guide plate is urged toward the transfer position by spring members, and can absorb the springing of the transfer media back to its original shape by pivoting away from the transfer position, and thus can reduce the occurrences of image blurring or the like.

5 Claims, 5 Drawing Sheets

TRANSFER MEDIA TRANSPORT GUIDE MECHANISM FOR IMAGE FORMING DEVICE

CROSS-REFERENCE TO RELATED APPLICATIONS

This application is a continuation application of U.S. patent application Ser. No. 10/908,576 filed on May 17, 2005. The entire disclosure of U.S. patent application Ser. No. 10/908,576 is hereby incorporated herein by reference.

This application claims priority to Japanese Patent Application No. 2004-148102 filed on May 18, 2004. The entire disclosure of Japanese Patent Application No. 2004-148102 is hereby incorporated herein by reference.

BACKGROUND OF THE INVENTION

1. Field of the Invention

The present invention relates to an image forming device, and more particularly to an image forming device that includes a pair of guide plates that guide transfer media transported upward from resist rollers to a transfer position between an image support member on which toner images are formed and a transfer member.

2. Background Information

The majority of image forming devices, and in particular color image forming devices such as color copy machines or color printers, are now multi-stage drum type (tandem type) rather than single drum type, and are capable of high speed processing. The image forming units of a tandem type color image forming device are aligned with each other in the direction in which the paper is transported, and are separated by color, e.g., magenta, yellow, cyan, and black. A color toner image is sequentially formed by means of these image forming devices.

Each color image forming unit is arranged opposite an intermediate transfer belt (an image supporting member), and toner images sequentially formed with each color image forming unit will be transferred to the intermediate transfer belt. The intermediate transfer belt endlessly extends around a plurality of rollers. A primary transfer roller, and a secondary roller which forms a transfer position, are arranged on the outside of the intermediate transfer belt. In addition, transfer media will be transported from a media supply unit to the transfer position via a pair of resist rollers. Toner images on the photosensitive drums will be transferred to the transfer media at the transfer position by applying a transfer bias voltage to the secondary transfer roller. Then, in order to accurately transfer the toner images on the surfaces of the photosensitive drums to the transfer medium and obtain a good image, the transfer media transported from the resist rollers must be guided to an appropriate transfer position. Thus, a pair of guide plates are provided on the upstream side in the transfer medium transport direction of the transfer position, and serve to guide the transfer media transported from the pair of resist rollers to the appropriate transfer position.

Recently, there has not only been an increase in the number of copy machines having both copy and print functions, but due to demands for smaller devices and an increase in the speed of image formation, there has also been an increase in devices which have perpendicular transport paths. These types of devices have image forming means, fixing means, and the like that are arranged perpendicular to each other, and transport transfer media upward. With image forming devices having this type of perpendicular transport path, it is often the case that transfer media is not transported in a straight line between the pair of resist rollers and the transfer position. This is done in order to shorten the transport path. In addition, in situations in which the transfer media is resilient and capable of returning to its original shape after being bent, e.g., when the transfer media is thick paper such as cardboard, it will be easy for images formed on transfer media to become blurred due to the fact that the rear portion of each transfer media will spring back to its original shape after it separates from the resist rollers.

A pre-transfer guide device is designed to pivot around the rotation shaft of the secondary transfer roller in order to smoothly pass even resilient transfer media such as cardboard through the transfer position without jamming. In addition, a pre-transfer guide device has been proposed in which a restriction means is provided on the secondary roller side that will restrict the amount of pivot by the pre-transfer guide members.

With the structure disclosed in Japanese Unexamined Patent Application Publication No. H09-240880, resilient transfer media such as cardboard can smoothly pass through the pre-transfer guide device due to the pivoting and retraction of the pre-transfer guide members. When cardboard is to be passed to a transfer location, the secondary transfer roller will be retracted from the photosensitive drum at a distance equal to the thickness of the cardboard. However, when the pre-transfer guide device is designed to pivot around the rotation shaft of the secondary transfer roller, it will often be the case that the pre-transfer guide members will retract from the transfer position at a distance equal to the distance in which the secondary transfer roller is retracted, and thus the transfer media cannot be guided to an appropriate transfer position. In addition, the restriction means that restricts the amount that the pre-transfer guide members can pivot is provided on the secondary transfer roller side. Thus, when transfer media is to be passed through the transfer position, the secondary transfer roller will retract from the photosensitive drum at a distance equal to the thickness of the cardboard, and it will be difficult to restrict the pre-transfer guide members to a predetermined amount of pivot.

Accordingly, an object of the present invention is to provide an image forming device that can control image blurring, image shrinkage, and the like when resilient transfer media such as cardboard is to be transported upward from a pair of resist rollers and guided to a transfer position, and obtain suitable transfer images.

In view of the above, there exists a need for an image forming device which overcomes the above mentioned problems in the prior art. This invention addresses this need in the prior art as well as other needs, which will become apparent to those skilled in the art from this disclosure.

SUMMARY OF THE INVENTION

An image forming device according to a first aspect of the invention includes an image forming unit, a transfer member, and a transfer media transport guide mechanism. The image forming unit includes an image support member on which toner images will be formed. The transfer member is arranged opposite the image support member, and serves to transfer toner images formed on the image support member to transfer media. The transfer media transport guide mechanism serves to guide transfer media between the image support member and the transfer member, and includes a pair of guide plates and a support unit. The pair of guide plates are provided on a image support member side and a transfer member side of the transfer media transport guide, and serve to guide transfer media to a transfer position that is between the image support member on which toner images are formed and the transfer member. The support unit serves to pivotably support the guide plate on the transfer member side so that the guide plate is independent of the transfer member.

When image formation begins in this image forming device, a toner image is formed on the image support member, a transfer medium is transported from a pair of resist rollers at a timing that matches the formation of the toner image, and the toner image is transferred to the transfer medium. Due to the transfer media transport guide mechanism, the transfer medium will be guided to the transfer position between the image support member on which toner images are formed and the transfer member. Due to the presence of the support unit, the guide plate on the transfer member side is pivotably supported and independent of the transfer member. Thus, even in situations in which resilient transfer media such as cardboard is transported, the springing of the transfer media back to its original shape when an end of a transfer medium separates from the resist rollers can be absorbed by pivoting the guide plate on the transfer member side.

The image forming device according to a second aspect of the present invention is the image forming device of the first aspect, and further includes a position regulating member. The position regulating member serves to fix the distance between the guide plate on the transfer member side and the guide plate on the image support member side. Due to the position restricting member, transfer media will be guided to the appropriate transfer position, and thus an optimal transfer image can be obtained.

The image forming device according to a third aspect of the present invention is the image forming device of the first aspect, in which the support unit includes a transfer unit housing in which the transfer member is held, and at least one spring member that is provided between the guide plate on the transfer member side and the transfer unit housing.

With this device, the support unit includes a transfer unit housing and at least one spring member. The spring member can pivotably support the guide plate on the transfer member side so that the guide plate is independent of the transfer member.

With conventional technology, the pre-transfer guide device is pivoted together with the transfer roller, and thus there are times in which the pre-transfer guide member will move away from the transfer position at a distance equal to the distance from the image support member of the transfer roller when resilient transfer media such as cardboard passes through the transfer position, and thus transfer media cannot be guided to the appropriate transfer position. However, with the transfer media transport guide mechanism of the present invention, the guide plate on the transfer member side can be pivoted independent of the transfer member, and thus the aforementioned situation can be avoided, and transfer media can be guided to the appropriate transfer position.

The image forming device according to a fourth aspect of the present invention is the image forming device of the second aspect, in which the position restricting unit is provided on the guide plate on the transfer member side, and which maintains a gap between the guide plate on the transfer member side and the guide plate on the image support member side.

With conventional technology, restriction means that restricts the amount that the pre-transfer guide members can pivot is provided on the transfer roller side. Thus, when transfer media passes through the transfer position, the transfer roller will retract from the transfer position at a distance equal to the thickness of the transfer media, and it will be difficult to restrict the pre-transfer guide member to a predetermined amount of pivot. With the mechanism of the present invention, the position restricting unit can overcome the aforementioned problems because the guide plate on the transfer member side is provided. In addition, the guide plate on the image support member side is fixed to the image forming device, and the distance from the transfer position is also fixed. Thus, the gap between the guide plate on the transfer member side and the guide plate on the image support member side in the area where transfer media are inserted can be fixed, without regard to the thickness of the transfer media, and transfer media can be stably guided to the transfer position.

The image forming device according to a fifth aspect of the present invention is the image forming device of the third aspect, in which the transfer unit housing can be opened and closed with respect to the image forming device.

With this image forming device, the transfer unit housing that holds the transfer member and supports the guide plate on the transfer member side can be opened and closed with respect to the image forming device. Thus, it will be easier to perform maintenance on the image forming device as well as clear jams therein.

The image forming device according to a sixth aspect of the present invention is the image forming device of the first aspect, in which the surface of the guide plate on the transfer member side that comes into contact with transfer media is made from a electrically conductive material, and the transfer member side of the guide plate is made from an electrically insulating material.

Because the surface of the guide plate on the transfer member side that comes into contact with the transfer media is electrically conductive, electric charge formed on the surface of transfer media can be removed, and image fogging can be controlled. In addition, when resilient transfer media such as cardboard is to be passed through the transfer media transport guide mechanism, the guide plate on the transfer member side will approach the transfer member side at a distance equal to the thickness of the transfer media due to the pivoting of the support unit provided on the transfer member side. However, because the surface on the transfer member side is made of an electrically insulating material, there will be no effect on the bias charge on the transfer member, and thus can prevent image fogging.

The image forming device according to a seventh aspect of the present invention is the image forming device of the first aspect, in which the transfer media transport guide mechanism serves to transport transfer media upward and guide transfer media between the image support member and the transfer member. With an image forming device having a perpendicular transport path, it is often the case that the transport direction of the transport media between the resist rollers and the transfer position will not be straight in order to shorten the transport path, and thus it will be easy for images formed on transfer media to become blurred due to the transfer media springing back to its original shape when the rear portion of the transfer media separates from the resist roller.

Accordingly, with a image forming device having a transfer media transport guide mechanism that transports transfer media upward, the guide plate on the transfer member side is pivotably supported by the support unit so as to be independent of the transfer member. Thus, even in situations in which resilient transfer media such as cardboard is transported, the springing of the transfer media back to its original shape when the ends of the transfer media separate from the resist rollers can be absorbed by pivoting the guide plate on the transfer member side.

The image forming device according to an eighth aspect of the present invention is the image forming device of the first aspect, in which the transfer member is a transfer roller that is arranged opposite the image support member.

With the image forming device of the present invention, by urging the guide plate on the transfer member side so that it can pivot independent of the transfer member, image blurring, image shrinkage, and the like that occurs when resilient transfer media such as cardboard or the like is transported upward can be controlled, and an appropriate transfer image can be obtained.

These and other objects, features, aspects, and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
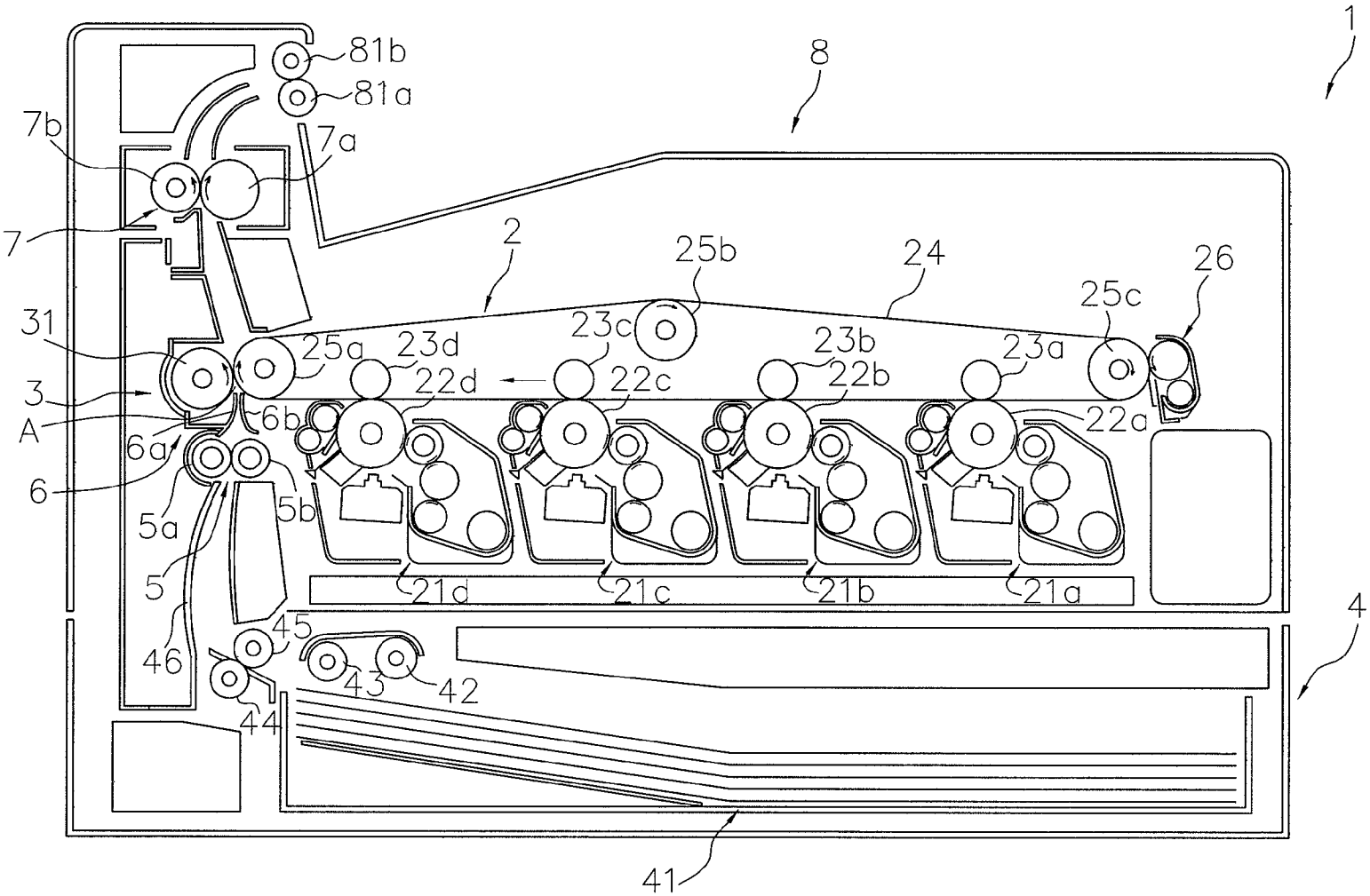
FIG. 1 shows the primary elements of a color printer.

FIG. 1 shows the primary components of a tandem type color printer 1 in which an embodiment of the present invention has been adopted. The color printer 1 includes an image forming unit 2 used for color image formation, a transfer unit 3 that transfers toner images formed with the image formation unit 2 to transfer media, a media supply unit 4 that supplies transfer media, resist rollers 5 that serve to synchronize the transport of transfer media with image formation, a transfer media transport guide mechanism 6 that guides transfer media that has arrived at the resist rollers 5 to a transfer position, a fixing unit 7 that fixes toner images transferred to transfer media, and a discharge unit 8 that discharges transfer media.

The image forming unit 2 is positioned in the approximate center of the color printer, has four developing units 21*a*, 21*b*, 21*c*, 21*d* arranged therein which correspond to four colors (black, yellow, cyan, magenta), and includes photosensitive drums 22*a*, 22*b*, 22*c*, 22*d* on the surfaces of which electrostatic latent images are formed, primary transfer rollers 23*a*, 23*b*, 23*c*, 23*d* that are arranged opposite the photosensitive drums 22*a*, 22*b*, 22*c*, 22*d* and transfer toner images formed on the surfaces of the photosensitive drums, and an intermediate transfer belt 24 that serves as an image support member.

Figure 2:
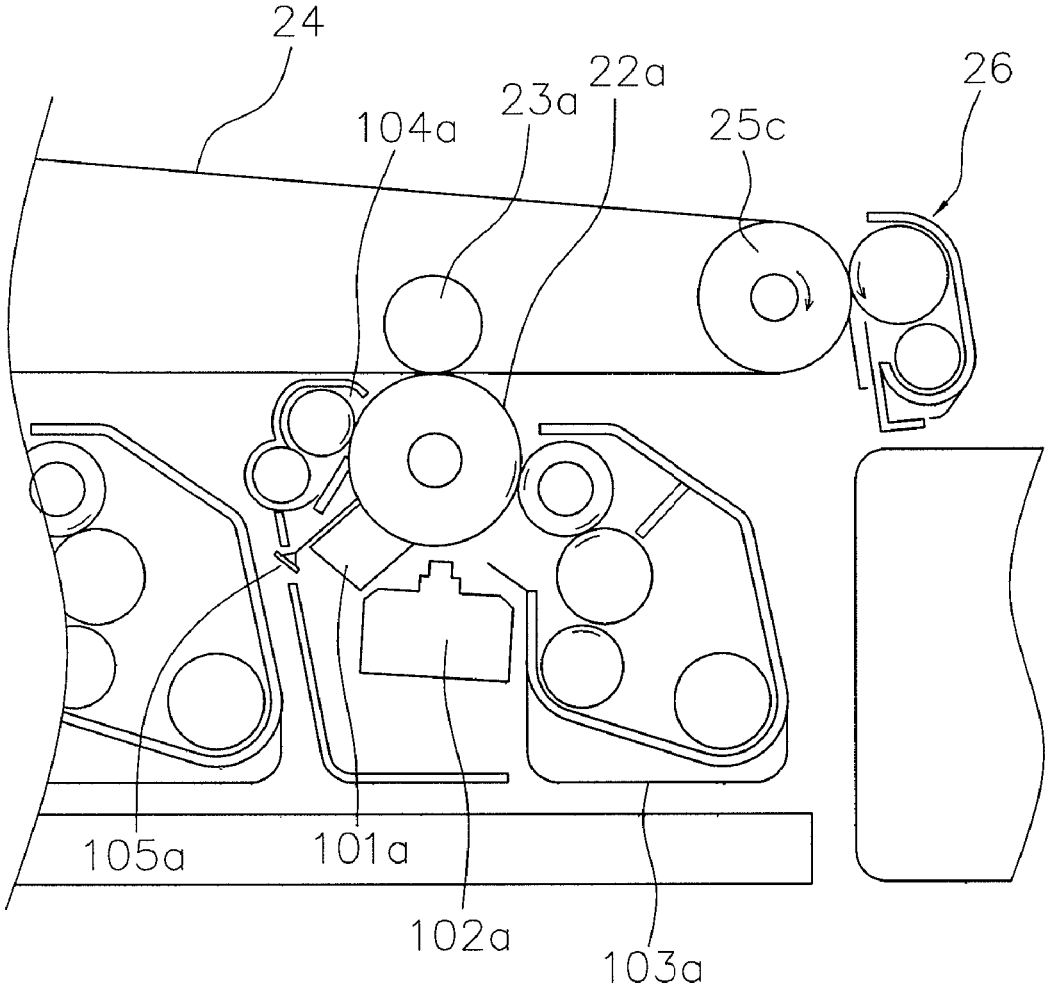
FIG. 2 is an enlarged view of a black developing unit.

Here, the internal structures of the four developing units are identical, and thus the internal structure of the black developing unit 21*a* will be described below as an example. As shown in FIG. 2, an electrostatic charging device 101*a*, an exposure device 102*a*, a developing device 103*a*, a cleaning device 104*a*, and a charge removal device 105*a* are arranged around the periphery of the photosensitive drum 22*a* of the black developing unit 21*a*.

The intermediate transfer belt 24 is arranged above each photosensitive drum 22*a*, 22*b*, 22*c*, 22*d*, and extends between and circulates around a drive roller 25*a* that is rotatively driven by a drive means such as a motor or the like (not shown in the figures), and a driven roller 25*c* that is arranged separately from the drive roller 25*a*. A tension roller 25*b* is provided between the drive roller 25*a* and the driven roller 25*c*. The primary transfer rollers 23*a*, 23*b*, 23*c*, 23*d* are respectively urged toward the photosensitive drums 22*a*, 22*b*, 22*c*, 22*d* so as to be in pressing contact therewith via the intermediate transfer belt 24, and thus the intermediate transfer belt 24 is in pressing contact with the photosensitive drums 22*a*, 22*b*, 22*c*, 22*d*. In addition, an intermediate transfer cleaning device 26 is provided in a position opposite the driven roller 25*c*, and serves to clean toner and the like that adheres to the intermediate transfer belt 24.

The media supply unit 4 is provided below the image forming unit 2, and includes a cassette 41 that stores transfer media, pick-up rollers 42, 43 for removing transfer media stored in the cassette 41, and media supply rollers 44, 45 for sending transfer media into a transport path one page at a time. Transfer media that has been transported from the media supply unit 4 is transported through a vertical transport path 46 to a transfer position. Resist rollers 5*a*, 5*b* are provided on the downstream side of the vertical transport path 46, will grasp transfer media that has been transported from the media supply unit 4 to that point, and will send transfer media to a transfer position A so as to be synchronized with image formation on the intermediate transfer belt 24.

The fixing device 7 is provided above the transfer unit 3, and serves to melt and fix toner that has been transferred to transfer media. The fixing device 7 includes a heat roller 7*a* that includes a heater therein, and a pressure roller 7*b* that is pressed into contact with the heat roller 7*a*. The fixing device 7 will both grasp and transport transfer media between both rollers, but also apply heat to fix toner images transferred to the surface of transfer media. Discharge rollers 81*a*, 81*b* are provided above the fixing device 7, and transfer media on which toner images are formed will be discharged to the discharge unit 8 provided on top of the color printer via the discharge rollers 81*a*, 81*b*.

Figure 3:
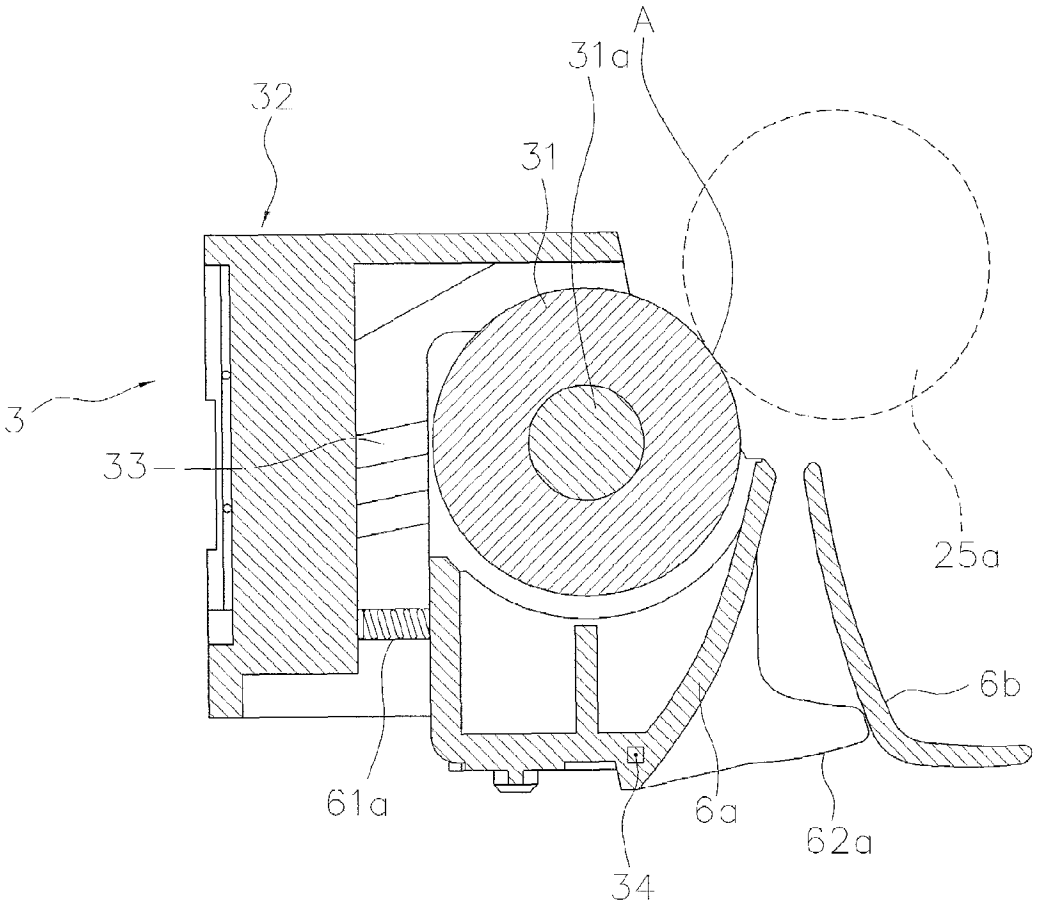
FIG. 3 shows the positional relationships of a transfer media transport guide mechanism.

The transfer unit 3 is arranged in a position that faces the drive roller 25*a*, with the drive roller 25*a* also serving as a secondary transfer opposing roller on the left side of the image forming unit 2 as shown in FIGS. 1 and 3. The transfer unit 3 includes a secondary transfer roller 31 (which serves as a transfer roller in this embodiment), a transfer unit housing 32, and a support member 33. The secondary transfer roller 31 is rotatably installed on a rotation shaft 31*a*, and forms the transfer position A between the drive roller 25*a* via the intermediate transfer belt 24. The transfer unit housing 32 supports the secondary transfer roller 31 and a guide plate 6*a* on the secondary transfer roller 31 side. The support member 33 serves to support the secondary transfer roller 31 so as to extendably and retractably pivot the secondary transfer roller 31 to and from the transfer position A. One end of the support member 33 is installed on the transfer unit housing 32, and the other end thereof is installed on a bearing of the secondary transfer roller 31.

The transfer media transport guide mechanism 6 is provided between the resist rollers 5*a*, 5*b* and the transfer position A as shown in FIGS. 1 and 3, and is primarily formed of a pair of guide plates 6*a*, 6*b*. The pair of guide plates 6*a*, 6*b* are plate shaped objects that extend along a direction that is perpendicular to the direction in which transfer media is transported (i.e., the axial direction of the secondary transfer roller), and are short in the transfer media transport direction. As shown in FIG. 3, both end portions in the lengthwise direction of the guide plate 6*a* are installed on the transfer housing 32 that is fixed to the image forming device by means of spring members 61*a*, 61*b* (spring member 61*b* not shown in the figures). The guide plate 6*a* is supported so that it can be extendably and retractably pivoted with respect to the transfer unit housing 32 and the transfer position A. In other words, because the spring members 61*a*, 61*b* are provided on both ends in the lengthwise direction of the guide plate 6*a*, the guide plate 6*a* is independent from the secondary transfer roller 31 and is supported so that it can be extendably and retractably pivoted with respect to the guide plate 6*b*. Note also that the guide plate 6*a* is formed so as to be pivotable around a pivot shaft 34, and the pivot shaft 34 is rotatably supported on the transfer housing 32. Projections 62*a* and 62*b* (see FIG. 4) are provided on both ends of the guide plate 6*a*. The projections 62*a*, 62*b* are elastically urged by spring members 61*a*, 61*b* toward the frame of the guide plate 6*b* (not shown in the figures), and come into contact with the guide plate 6*b*. The guide plate 6*b* is fixed to the housing of the image forming device by means of the frame. The projections 62*a*, 62*b* maintain a gap between the guide plate 6*a* and the guide plate 6*b* on the side in which transfer media will enter.

Here, when resilient transfer media such as cardboard is transported, there will be times in which the transfer media will spring back to its original shape at the point in which the ends of the transfer media separate from the resist rollers 5*a*, 5*b*. When resilient transfer media such as cardboard it to pass through the transfer position, the tip of the guide plate 6*a* that is urged toward the guide plate 6*b* by the spring members 61*a*, 61*b* will rotate around the pivot shaft 34 in a direction away from the guide plate 6*b*, and thus the springing back into shape of the ends of transfer media after separation from the resist rollers 5*a*, 5*b* will be absorbed, and thereby reduce the occurrence of image blurring and the like. Furthermore, even if the guide plate 6*a* rotates around the pivot shaft 34 when resilient transfer media such as cardboard passes through, because the projections 62*a*, 62*b* provided on the guide plate 6*a* will only move in the approximately horizontal direction, and the guide plate 6*a* will be pressed by the spring member 61*a*, a gap will be maintained in the transfer media entry position of the guide plate 6*a* and the guide plate 6*b*.

Figure 4:
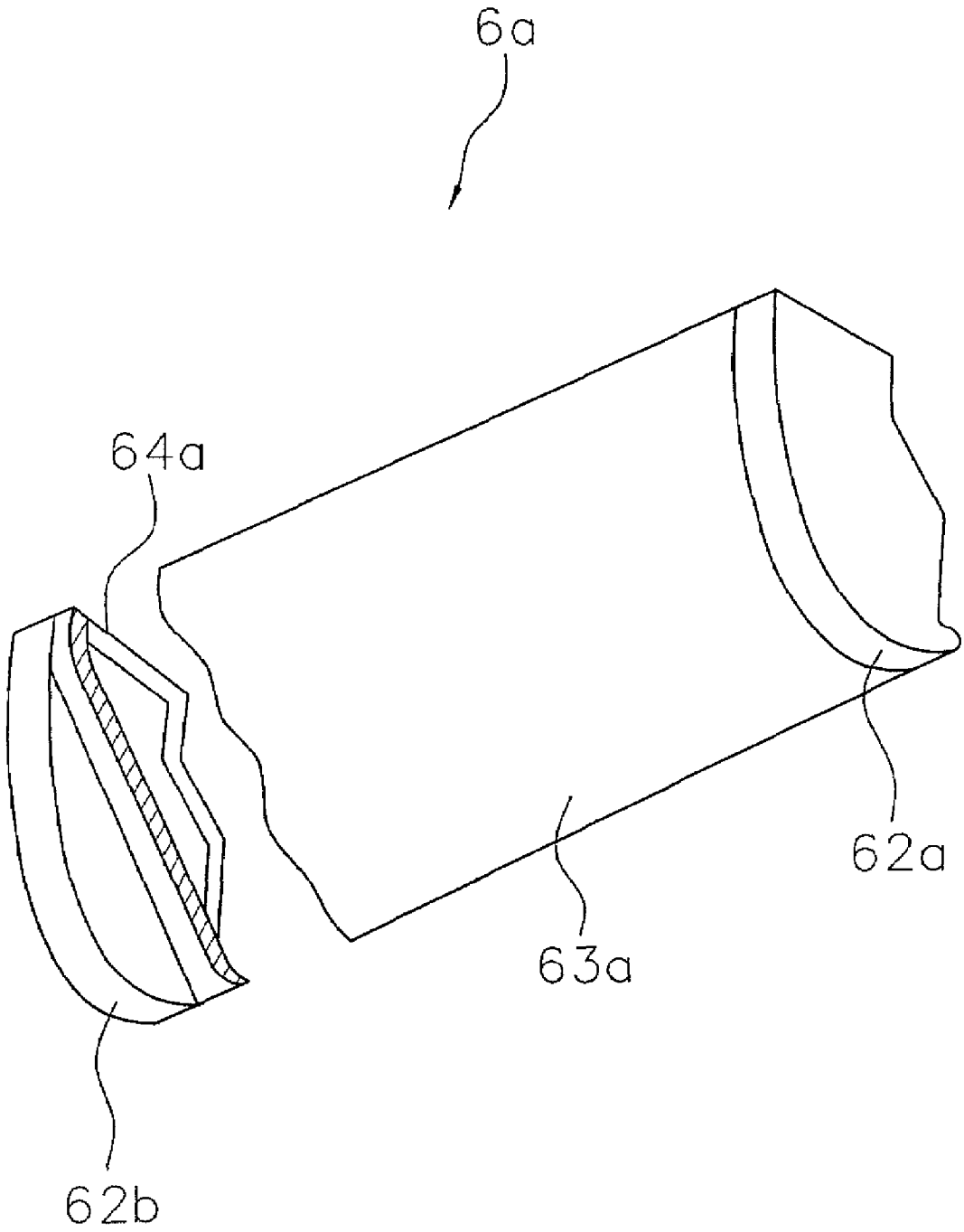
FIG. 4 is an oblique view of the transfer media transport guide mechanism.

In addition, as shown in FIG. 4, a surface 63*a* of the guide plate 6*a* that comes into contact with transfer media is formed from an electrically conductive material, and thus will remove an electric charge formed on the surfaces of transfer media. The opposing side 64*a* of the surface 63*a* is formed from an electrically insulating material, and thus even when the guide plate 6*a* pivots independently of the secondary transfer roller 31 at the point in which resilient transfer media such as cardboard passes through the guide plates and comes near the secondary transfer roller 31, there will be no effect on the bias charge on the secondary transfer roller, and therefore can prevent transfer image fogging.

Figure 5:
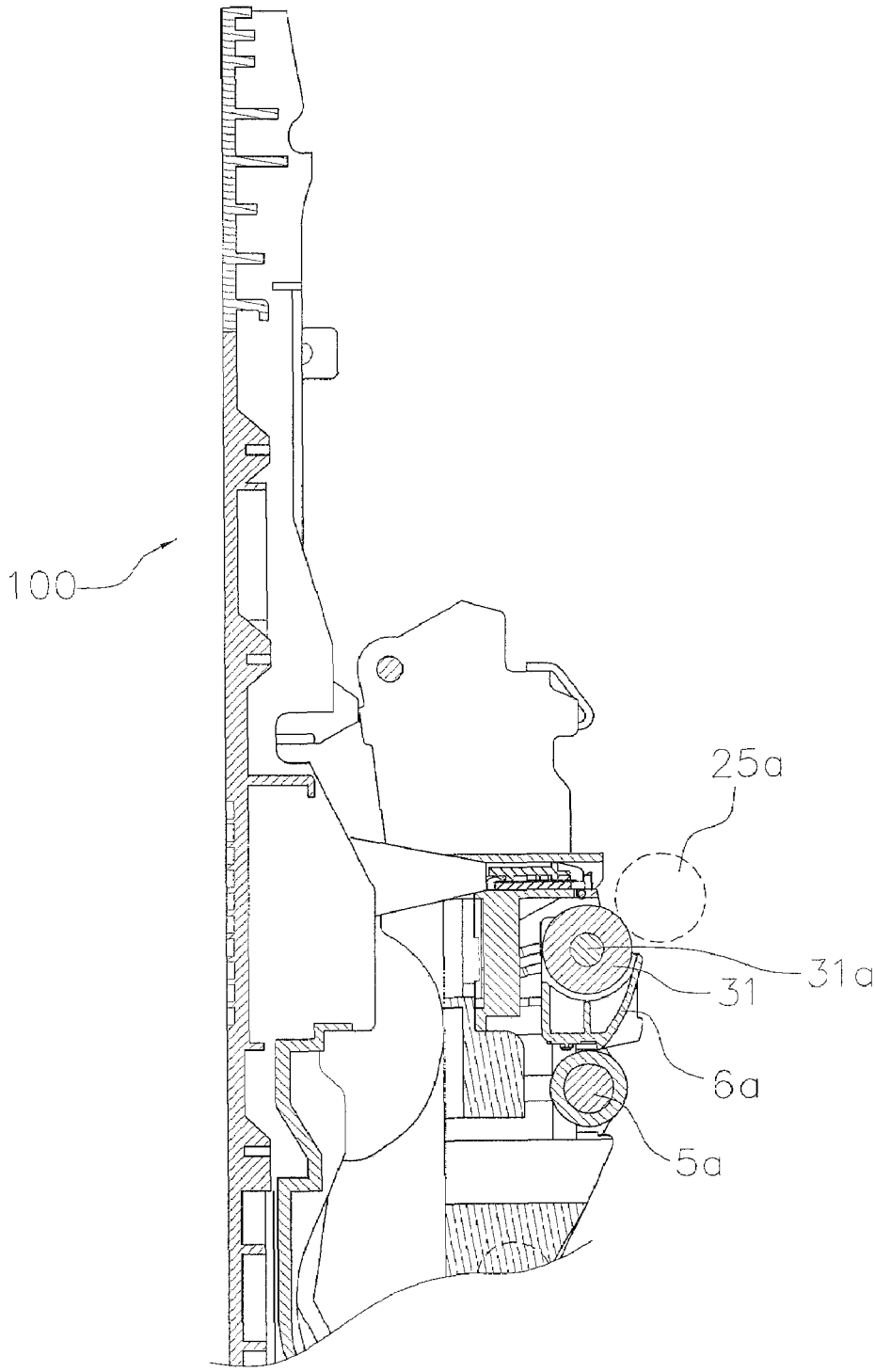
FIG. 5 is a schematic view of an open/close unit.

Furthermore, as shown in FIG. 5, the secondary transfer roller 31 and guide plate 6*a* are maintained in a unit 100, and the unit 100 can be opened and closed between a position near the color printer 1 and a position apart therefrom.

Next, the image formation operation will be described. First, when the power to the color printer 1 is turned on, each parameter thereof will be initialized, and initial settings such as the temperature setting of the fixing unit will be performed. Image data will be received from a personal computer or the like connected by means of a network to a image data input unit (not shown in the figures). The image data received here will be send to the image forming unit 2.

Toner images will be formed in each developing unit 21*a*, 21*b*, 21*c*, 21*d* of the image forming unit 2 based upon the received image data, but here, the image forming operation will be described by using the black developing unit 21*a* as an example. First, the photosensitive drum 22*a* is electrostatically charged by the electrostatic charging device 101*a*, exposure corresponding to the black image data is performed by the exposure device 102*a*, and an electrostatic latent image corresponding to the black image data is formed on the surface of the photosensitive drum 22*a*. The electrostatic latent image will be turned into a toner image by the black developing device 103*a*, and will be transferred onto the intermediate transfer belt 24 by means of a transfer bias applied by the primary transfer roller 23*a*. Toner remaining on the photosensitive drum 22*a* will be cleaned by the cleaning device 104, and will be dumped into a waste toner container (not shown in the figures). Furthermore, electric charge is removed from the photosensitive drum 22*a* by the charge removal device 105*a*. The aforementioned operation will also be performed with the magenta developing unit 21*b*, the cyan developing unit 21*c*, and the yellow developing unit 21*d*, and a full color toner image will be formed on the intermediate transfer belt 24.

Simultaneously therewith, a transfer medium will be removed from the media supply cassette 41 by the pick-up rollers 42, 43, and will be sent to the vertical transport path 46 via the paper supply rollers 44, 45. Then, the transfer medium will be transported by the resist rollers 5*a*, 5*b*, and guided to the transfer unit 3 by the transfer media transport guide mechanism 6 so as to match the timing of the image formation on the intermediate transfer belt 24. In the transfer unit 3, the secondary transfer roller 31 will contact the intermediate transfer belt 24, and the full color toner image formed on the intermediate transfer belt 24 will be transferred to the transfer medium by means of a secondary transfer bias applied by the secondary transfer roller 31. The full color toner image transferred to the transfer medium is fixed to the transfer medium by the application of heat and pressure from the fixing means 7, and the transfer medium on which the full color toner image is formed will be discharged to the discharge unit 8. In addition, toner remaining on the intermediate transfer belt 24 will be cleaned by the intermediate transfer cleaning device 26, and will be disposed of in the waste toner container (not shown in the figures).

Next, the transport of transport media will be described in detail. As shown in FIG. 1, when image formation is to be performed with the color printer 1, a transfer medium is supplied from the media supply unit 4, and is transported upward by the resist rollers 5*a*, 5*b*. The transfer medium is guided toward the transfer position A on the upstream side of the pair of guide plates 6*a*, 6*b*. Here, when a resilient transfer medium such as cardboard is transported, there will be times in which the transfer medium will spring back to its original shape at the point in which the end of the transfer medium separates from the resist rollers 5*a*, 5*b*. The tip of the guide plate 6*a*, which is urged toward the guide plate 6*b* by the spring members 61*a*, 61*b*, can absorb the springing of the transfer medium back to its original shape after it separates from the resist rollers 5*a*, 5*b* by pivoting away from the guide plate 6*b*, and thereby reduce the occurrence of image blurring and the like. Because the surface of the guide plate 6*a* that does not come into contact with the transfer medium is made of an electrically insulating material, even if the guide plate 6*a* pivots away from the guide plate 6*b* and comes near the secondary transfer roller 31, there will be no effect on the bias charge applied to the secondary transfer roller 31, and thus fogging of the transfer image can be prevented. On the other hand, when a transfer medium such as cardboard passes through transfer position A, the secondary transfer roller 31 will also separate from the transfer position A in a distance equal to the thickness of the transfer medium due to the pivot member 33. However, because the guide plate 6*a* pivots independently of the secondary transfer roller 31, there is no relationship with the pivoting of the secondary transfer roller 31 and thus the transfer medium can be guided to the appropriate transfer position.

In addition, the projections 62*a*, 62*b* provided on the guide plate 6*a* are resiliently urged toward the frame of the guide plate 6*b* (not shown in the figures), and come into contact with the guide plate 6*b*. The guide plate 6*b* is fixed to the housing of the image forming device by means of the frame. The projections 62*a*, 62*b* maintain a gap between the guide plate 6*a* and the guide plate 6*b* on the side in which transfer media will enter.

In the present embodiment, by designing a transfer guide device that will pivot around a rotation shaft of a transfer roller with conventional technology, a pre-transfer guide member will move away from a transfer position at a distance that is equal to the distance that a transfer roller will move when resilient transfer media such as cardboard passes through the transfer position, the inability of transfer media to be guided to an appropriate transfer position can be avoided, and transfer media can be guided to an appropriate transfer position, because the guide plate on the secondary transfer roller side is independent of the secondary transfer roller and can be urged to come near to or away from the transfer position.

Other Embodiments

In the aforementioned embodiment, an example was illustrated in which a tandem type color printer was employed as the image forming device, the image support member was an intermediate transfer belt, and the transfer roller was a secondary transfer roller. However, it goes without saying that the present invention can also be applied in situations in which a monochrome printer is employed as the image forming device, the image support member is a photosensitive drum, and the transfer roller is one which transfers toner images formed on a photosensitive drum to transfer media. In addition, the present invention can also be applied to an image forming device 10 such as a copy machine, a printer, a facsimile device, or the like.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image forming device, comprising:

an image forming unit having an image support member, toner images being formed on the image support member; and a transfer unit being configured to transfer the toner images formed on the image support member to transfer media, the transfer unit having a transfer unit housing, a transfer member having a rotation shaft and being formed on the transfer unit housing, and a first guide plate being arranged only on an upstream side of a nip being formed between the image support member and the transfer member, the first guide plate being arranged on the transfer unit housing via a support shaft and being pivotable on the support shaft independent of the rotation shaft of the transfer member, and being pivotable with respect to the transfer unit housing.

2. The image forming device according to claim 1, further comprising at least one spring member that urges the first guide plate to a second guide plate.

3. The image forming device according to claim 2, wherein the first guide plates has projections that come into contact with the second guide plate.

4. The image forming device according to claim 3, wherein the first guide plate has only two projections provided on opposite ends of the first guide plate.

5. The image forming device according to claim 4, wherein the projections maintain a gap between the first and second guide plates.

* * * * *